US008882529B2

(12) United States Patent
Weber et al.

(10) Patent No.: US 8,882,529 B2
(45) Date of Patent: Nov. 11, 2014

(54) LATCH ASSEMBLY HAVING SPRING ARMS EACH WITH A RETAINING PORTION AND A REINFORCED PORTION

(75) Inventors: Douglas J. Weber, Arcadia, CA (US); Naoto Matsuyuki, Nagoya (JP)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/607,600

(22) Filed: Sep. 7, 2012

(65) Prior Publication Data

US 2014/0057479 A1 Feb. 27, 2014

Related U.S. Application Data

(60) Provisional application No. 61/693,232, filed on Aug. 24, 2012.

(51) Int. Cl.
*H01R 13/627* (2006.01)
*H01R 43/26* (2006.01)
*H01R 13/639* (2006.01)

(52) U.S. Cl.
CPC ..... *H01R 13/639* (2013.01); *H01R 43/26* (2013.01)
USPC ..... 439/358

(58) Field of Classification Search
USPC ..... 439/352–358, 886–887
See application file for complete search history.

(56) References Cited

U.S. PATENT DOCUMENTS

| | | | | |
|---|---|---|---|---|
| 6,346,157 | B1 * | 2/2002 | Takezawa et al. | 148/580 |
| 6,406,320 | B1 * | 6/2002 | Wu | 439/358 |
| 8,297,603 | B2 * | 10/2012 | Imaizumi et al. | 267/174 |
| 8,308,150 | B2 * | 11/2012 | Tange et al. | 267/286 |
| 8,533,954 | B2 * | 9/2013 | Tange et al. | 29/896.9 |
| 8,607,605 | B2 * | 12/2013 | Tange et al. | 72/53 |
| 2009/0133785 | A1 * | 5/2009 | Ayada et al. | 148/567 |

* cited by examiner

*Primary Examiner* — Chandrika Prasad
(74) *Attorney, Agent, or Firm* — Kilpatrick Townsend & Stockton LLP

(57) ABSTRACT

A retention latch mechanism having a retention spring of a first connector engageable with a retention feature of a second connector. The retention spring may include a spring arm having a distal, curved retaining portion that is resiliently received within the retention feature and a reinforced portion that is proximal of the distal retaining portion. The reinforced portion includes a layer having residual compressive stress to inhibit fatigue failure during repeated cycling of the latch mechanism. The reinforced portion may be formed by a cold working method, such as shot peening a select region of the spring arm. The reinforced portion is formed to inhibit fatigue failure during repeated cycling of the latch mechanism. Methods of forming a retention mechanism having a retention spring with a reinforced portion are provided herein.

15 Claims, 12 Drawing Sheets

Linear analysis
• Load [N]: 8.8
• Maximum stress [N/mm$^2$]:1318

LATCH ASSEMBLY HAVING SPRING ARMS EACH WITH A RETAINING PORTION AND A REINFORCED PORTION

CROSS-REFERENCES TO RELATED APPLICATIONS

This application is a non-provisional of and claims priority to U.S. Provisional Application No. 61/693,232 filed on Aug. 24, 2012, the entire contents of which are incorporated herein by reference.

BACKGROUND OF THE INVENTION

The invention relates generally to retention mechanisms, and in particular retention mechanisms for use in electrical connectors.

Many devices include electrical connectors to facilitate communication between devices and/or recharging of the device by electrically coupling the device to an external power source. In a typical electrical connector system an electrical connection can be made between a plug connector and a corresponding receptacle connector by inserting the plug connector into the corresponding receptacle connector. Generally, the plug connector includes a group of electrical contacts that engage and electrically couple with corresponding electrical contacts within the receptacle connector when connected. To ensure proper contact is maintained between corresponding contacts, some electrical connectors include interfacing features or retaining features that engage to retain the connector plug within the receptacle connector. These interfacing surfaces or retention mechanisms or features may encounter wear-and-tear during use and experience fatigue failure after many cycles of use.

BRIEF SUMMARY OF THE INVENTION

Various embodiments of the invention pertain to a retention mechanism having increased fatigue strength, such as may be used in electrical connectors, that improves upon some or all of the above described deficiencies. Other embodiments of the invention pertain to methods of manufacturing electronic connectors as well as electronic devices that include such connectors having retention mechanisms.

In view of the shortcomings of some currently available electronic connectors described above, embodiments of the invention relate to connectors with improved retention mechanisms that provide retention forces between an electrical connector plug and a connector receptacle. The retention mechanism may provide an increased normal force between the electrical contacts of the electrical connector plug and the receptacle and improved ease of use by providing a more consistent feel when a connector plug is inserted and extracted from the receptacle. The mechanism includes a retention spring on a first connector, the retention spring having a retaining portion that interfaces and engages with a retention feature of a second connector, the retaining portion and the retention feature being engaged with the first and second connector when mated. In some embodiments, the mechanism includes a retention spring with a distal retaining portion and a proximal reinforced portion having a layer of compressive residual stress so as to inhibit fatigue failure of the proximal portion after many cycles of use. The compressive residual stress layer may be formed by a cold working process, such as shot peening, particularly a wide peening and cleaning (WPC) treatment. A WPC treatment uses relatively small particles of shot and may be used as a surface enhancement to reduce friction by smoothing a surface. When utilized on a select portion of a retention spring, as described herein, the compressive residual stress layer near the surface inhibits the formation of stress fractures, thereby improving the fatigue strength of the retention spring and prolonging the useful life of the component. Formation of a compressive residual stress layer over the entire retention spring is not required and improvement of the retention spring can be obtained by treatment of a select portion of the retention spring, such as a portion proximal of a retaining portion near a narrowing or shoulder region of the retention spring where a stress fracture may form after many cycles of use.

Although various aspects and features of the invention are described in relation to electrical connectors depicted in the accompanying figures, it is appreciated that these features and aspects can be used in a variety of different applications and different connector devices, and that the invention is not limited to the exemplary connectors described herein.

In one aspect, the invention pertains to a retention latch mechanism for use in an electrical connector device having an electrical connector plug and a corresponding receptacle. In some embodiments of the invention, electrical contacts are formed an at least one surface of the connector plug and arranged in a symmetrical layout so that the contacts align with contacts of the connector receptacle. When the connector plug is fully inserted into the receptacle into a mated configuration, the individual contacts on the connector plug are electrically coupled to the corresponding electrical contacts within the receptacle and a retention mechanism provides a retention force to maintain the electrical coupling between the connector plug and the receptacle.

Methods of creating a retention mechanism include: forming a retention spring having a distal, retaining portion and a proximal reinforced portion having a layer with residual compressive stresses. The proximal reinforced portion may be created by cold working methods, such as shot peening, as in any of the methods described herein.

To better understand the nature and advantages of the invention, reference should be made to the following description and the accompanying figures. It is to be understood, however, that each of the figures is provided for the purpose of illustration only and is not intended as a definition of the limits of the scope of the invention. In general, and unless it is evident to the contrary from the description, where elements in different figures use identical reference numbers, the elements are either identical or at least similar in function.

DETAILED DESCRIPTION OF THE INVENTION

The invention will now be described in detail with reference to certain embodiments thereof as illustrated in the accompanying drawings. In the following description, numerous specific details are set forth in order to provide a thorough understanding of the invention. It will be apparent, however, to one skilled in the art, that the invention may be practiced without some or all of these specific details. In other instances, well known details have not been described in detail in order not to unnecessarily obscure the concepts and principles of the invention.

Figure 1:
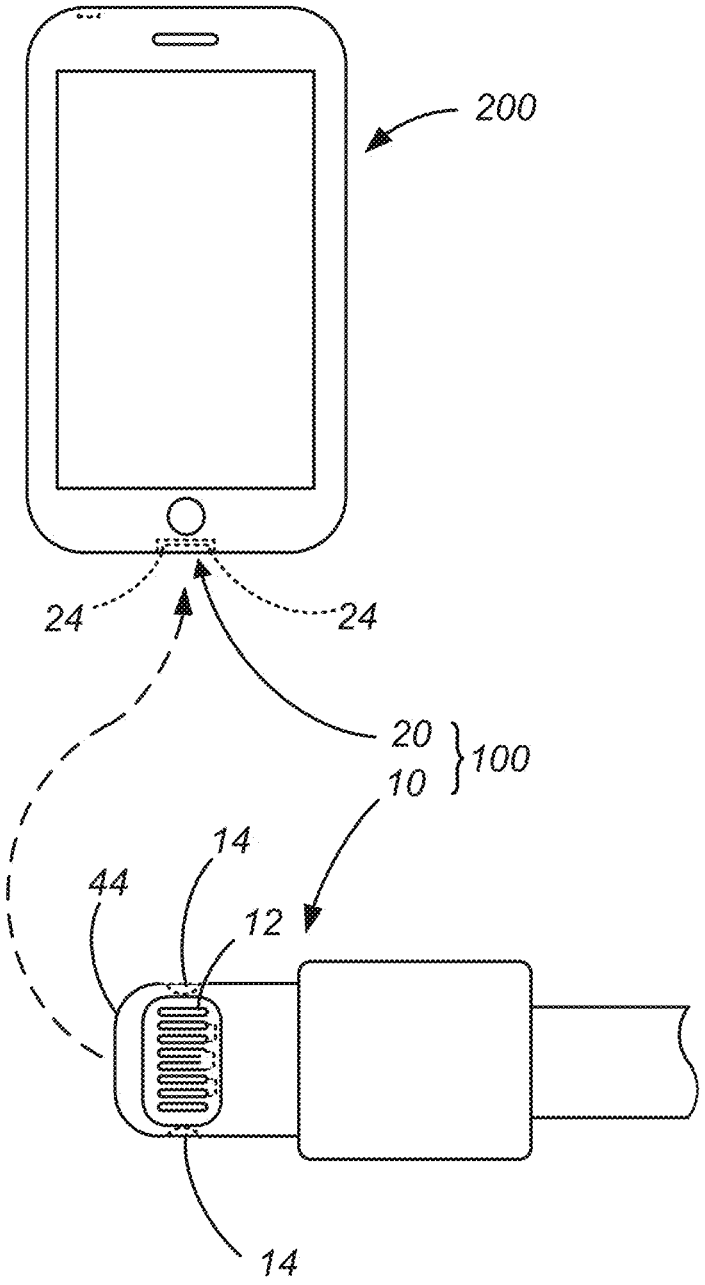
FIG. 1 shows an electrical connector device, in accordance with embodiments of the invention.

In order to better appreciate and understand the invention, reference is first made to FIG. 1 which is a simplified schematic representation of connector device 100 having a retention latch mechanism according to an embodiment of the invention. The connector device 100 includes a connector plug 10 insertable into the corresponding connector receptacle 20. The external contact connector plug 10 includes multiple electrical contacts 12 that can accommodate some or all of video, audio, data and control signals along with power and ground. Connector plug connector plug 44 is compatible with a connector receptacle 20 of a host device 200 that can be, for example, a portable media player. Each of the connector plug 10 and the connector receptacle includes retention features 14, 24, respectively, that engage when the connector plug 10 is fully inserted within the receptacle 20 in a mated configuration, so as to aid in the alignment and electrical contact between the components and maintain the components in the mated configuration.

Figure 2A:
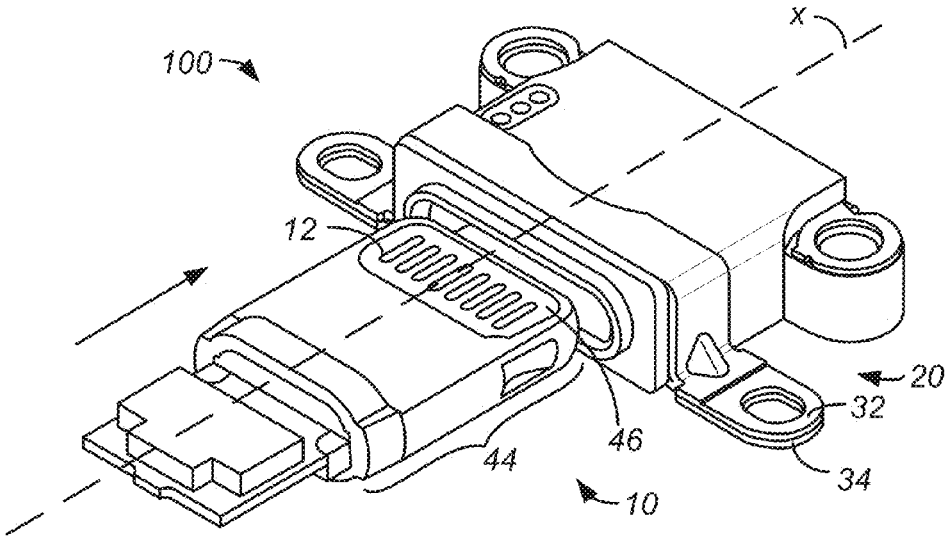
FIGS. 2A-2B illustrate an example electrical connector device.
Figure 2B:
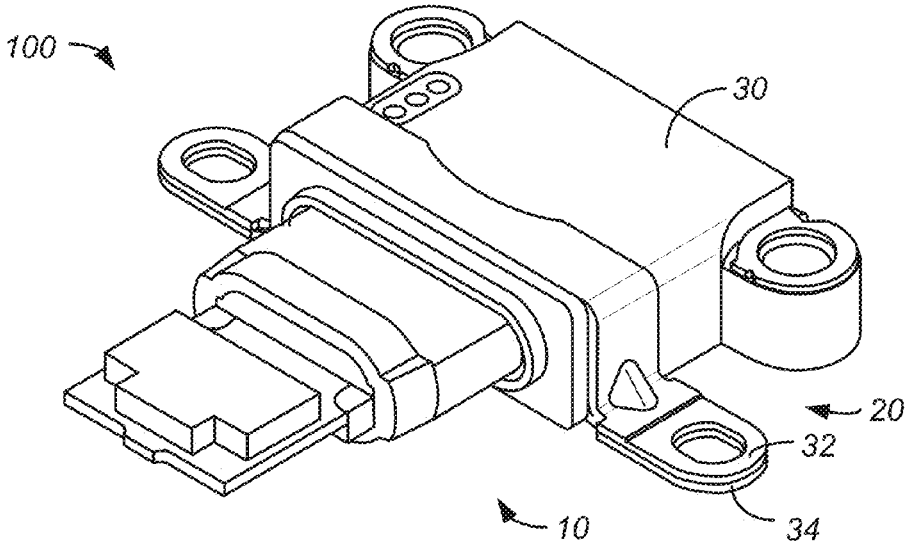

FIGS. 2A-2B illustrate an example electrical connector plug 10 before and after insertion into a compatible connector receptacle 20, respectively. As shown in FIG. 2A, the electrical connector 10 includes a connector plug 44 having electrical contact region 46 with a plurality of electrical contacts 12 for electrically coupling to corresponding electrical contacts (not shown) disposed inside the receptacle 20. The connector receptacle 20 is generally defined by an outer receptacle housing 30 that is attached to a surface or components on the interior of device 200, such as by use of one or more brackets 32, 34. In the embodiment shown, the connector receptacle housing 30 is coupled within the device using an upper bracket 32 that extends over the upper portion of the housing 30 and a lower bracket 34 that extends underneath housing 30. The end portions of each bracket 32 and 34 include holes for receiving a screw to facilitate mechanically coupling the housing 30 within the device 200. The connector plug 10 and connector receptacle are connected by inserting the connector plug 44 along insertion axis x until the connector plug 44 is fully inserted into a mated configuration in which corresponding electrical contacts 12, 22 are electrically coupled, as shown in FIG. 2B.

Figure 3A:
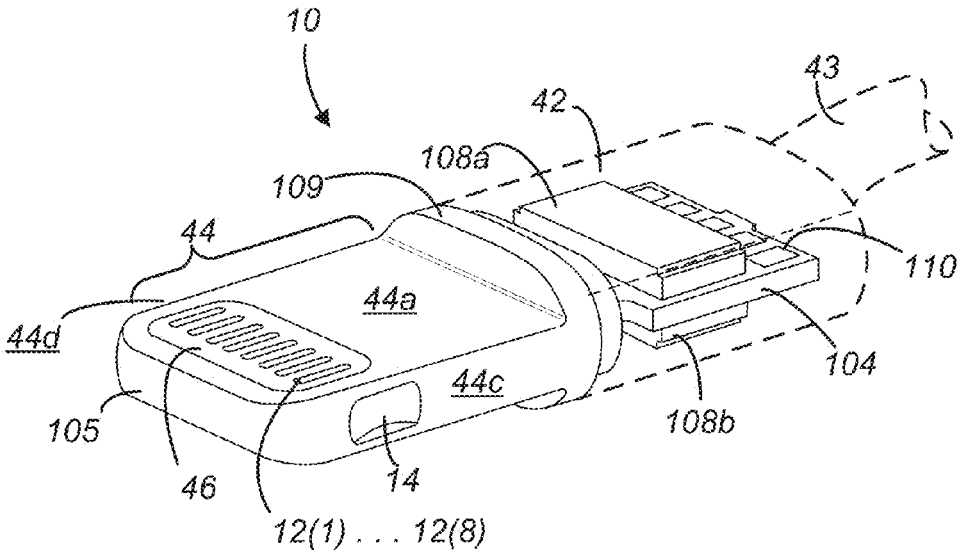
FIGS. 3A-3B show an example connector plug and receptacle an electrical connector device, in accordance with some embodiments.
Figure 3B:
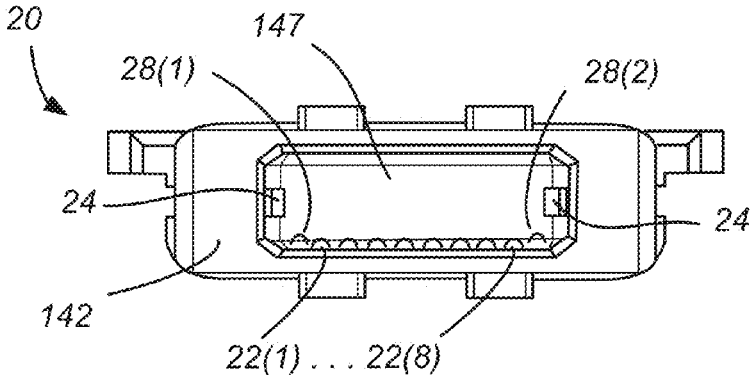
Figure 3C:
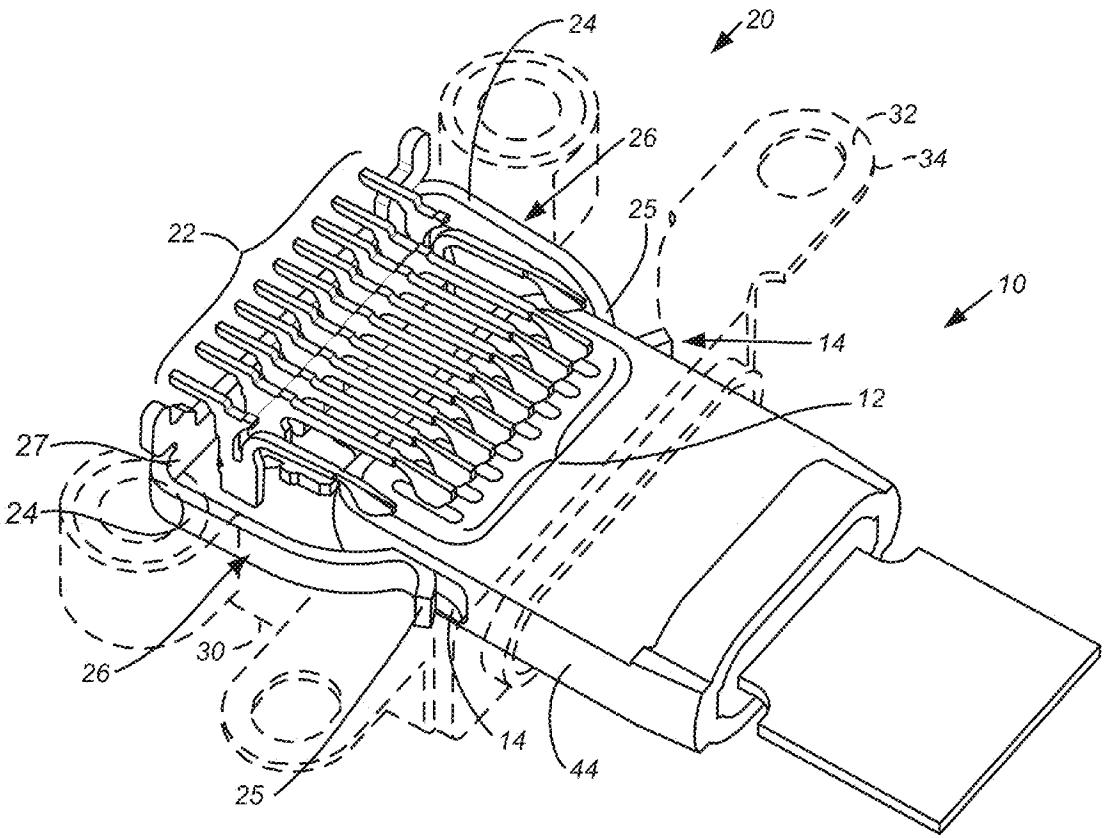
FIG. 3C shows an example connector plug.

FIGS. 3A-3C illustrate the connector plug 44 of the plug 10 and the connector receptacle 14 of FIGS. 2A-2B in further detail. FIG. 3A depicts the connector plug 10 having the insertable connector plug 44. Connector plug 10 includes a connector plug body 42 and the connector plug portion 44 that extends longitudinally away from body 42 in a direction parallel to the length of the connector plug 10. A cable 43 can optionally be attached to body 42 at an end opposite of connector plug portion 44. Body 42 is shown transparent form so that certain internal components are visible. As shown, within body 42 is a circuit board insert, such as a printed circuit board (PCB), 104 that extends into ground ring 105 between contact regions 46 and 46 towards the distal tip of connector plug 10. One or more integrated circuits (ICs), such as Application Specific Integrated Circuit (ASIC) chips 108*a* and 108*b*, can be operatively coupled to the circuit board insert 104 to provide information regarding connector plug 10 and any accessory or device that connector plug 10 is part of and/or to perform specific functions, such as authentication, identification, contact configuration and current or power regulation.

In the above embodiment, connector plug 44 is sized to be inserted into a corresponding connector receptacle 20 during a mating event and includes a first contact region 46 formed on a first major surface 44*a* extending from a distal tip of the connector plug to a spine 109 such that when connector plug 44 is inserted into the connector receptacle, the spline abuts a housing 30 of the connector receptacle or host device in which the connector receptacle resides. In one particular embodiment, connector plug 44 is 6.6 mm wide, 1.5 mm thick and has an insertion depth (the distance from the tip of connector plug 44 to spine 109) of 7.9 mm. Connector plug 44 may be made from a variety of materials including metal, dielectric or a combination thereof. For example, connector plug 44 may be a ceramic base that has contacts printed directly on its outer surfaces or may include a frame made from an elastomeric material that includes flex circuits attached to the frame. In some embodiments, connector plug 44 includes an exterior frame made primarily or exclusively from a metal, such as stainless steel, with a contact region 46 formed within an opening of the frame. The structure and shape of connector plug 44 may be defined by a ground ring 105 and made from stainless steel or another hard conductive material.

In this embodiment, contact region 46 is centered between the opposing side surfaces 44*c* and 44*d*, and a plurality of external contacts are shown formed on the top outer surface of connector plug 44 within the contact region. The contacts can be raised, recessed or flush with the external surface of connector plug 44 and positioned within the contact region such that when connector plug 44 is inserted into a corresponding connector receptacle they can be electrically coupled to corresponding contacts in the connector receptacle. The contacts can be made from copper, nickel, brass, stainless steel, a metal alloy or any other appropriate conductive material or combination of conductive materials. In some embodiments, contacts are printed on surfaces 44*a* using techniques similar to those used to print contacts on printed circuit boards. The contacts can be stamped from a lead frame, positioned within regions 46 and surrounded by dielectric material.

In one aspect, the connector plug 44 includes one or more retention features 14 corresponding to one or more retention features 24 within the receptacle 20. For example, the retention features of the connector plug 44 may include one or more indentations, recesses, or notches 14 on each side of connector plug 44 that engage with corresponding retention feature(s) 24 within the receptacle, the corresponding retention feature(s) 24 extending or protruding toward the insertion axis along which the connector plug 44 is inserted so as to be resiliently received within the indentation, notch or recess within the sides of connector plug 44. In one particular embodiment, retention features 14 are formed as curved pockets or recesses in each of opposing side surfaces 44*c*, 44*d*, the shape and location of the retention features 14 corresponding to complementary retention features 24 in the receptacle when in a mated configuration. Generally, the retention features 24 of the receptacle resemble spring-like arms configured to be resiliently received within retention feature recesses 14 once the connector plug 10 and receptacle 20 are properly aligned and mated. The engagement of these resilient retention features of the receptacle and the retention feature within the connector plug can be seen in more detail in FIG. 3C. The length of each spring-like arm extends about 8-10 mm along the insertion axis so as to retain the connector plug when fully inserted within the receptacle at an insertion depth of about 7.9 mm.

In some embodiments, one or more ground contacts are formed on connector plug 44, or may be included on an outer portion of connector plug 44. In some embodiments, the one or more ground contacts are formed within and/or as part of a pocket, indentation, notch or similar recessed region 14 formed on each of the side surfaces 44*c*, 44*d* (not shown in FIG. 3*a*), such that the retention feature 14 may also act as the electrical ground for connector plug 44.

FIG. 3B depicts a connector receptacle 20 in accordance with some embodiments. The connector receptacle 20 also includes side retention mechanisms 24 that engage with corresponding retention features 14 on connector plug 10 to secure connector plug 10 within cavity 147 once the connectors are mated. In some embodiments, the retention mechanisms 24 are resilient members or springs, often formed from an elongated arm that extends from a rear portion of the receptacle and extends toward the opening of cavity 147, such as shown in more detail in FIG. 3C. The retention mechanisms 24 may be made from an electrically conductive material, such as stainless steel, so that the feature can also function as a ground contact. The connector receptacle 20 can also include two contacts 28(1) and 28(2) that are positioned slightly behind the row of signal contacts and can be used to detect when connector plug 10 is inserted within cavity 140 and/or when connector plug 10 exits the cavity 147. When connector plug 44 of connector plug 10 is fully inserted within cavity 147 of connector receptacle 20 during mating between the connector plug and connector receptacles, each of contacts 12(1) . . . 12(8) from one of contact region 46 are physically coupled to one of contacts 22(1) . . . 22(8).

In this embodiment, body 42 of connector plug 10 is generally the portion of connector 40 that a user will hold onto when inserting or removing connector 40 from a corresponding connector receptacle. Body 42 can be made out of a variety of materials and in some embodiments is made from a dielectric material, such as a thermoplastic polymer formed in an injection molding process. While not shown in FIGS. 3A or 3B, a portion of cable 43 and a portion of connector plug 44 may extend within and be enclosed by body 42. Electrical contact to the contacts in contact region 46 can be made to individual wires in cable 43 within body 42. Cable 43 may include a plurality of individual insulated wires, one for each electrically unique contact within regions 46 and 46, that are soldered to bonding pads on a circuit board insert housed within body 42. Each bonding pad on the circuit board insert is electrically coupled to a corresponding individual contact within one of contact region 46. Also, one or more integrated circuits (ICs) can be operatively coupled within body 42 to the contacts within regions 46 to provide information regarding connector 40 and/or an accessory the connector is part of or to perform other specific functions as described in detail below.

In one aspect, body 42 may be fabricated in any of variety of suitable shapes, including a circular cross section, an oval cross section, or a rectangular cross-section. In some embodiments, such as shown in FIG. 3A, body 42 has a rectangular cross section with rounded or angled edges (referred to herein as a "generally rectangular" cross section), that generally matches in shape but is slightly larger than the cross section of connector plug 44. In some embodiments, both the body 42 and connector plug 44 of connector 10 have the same cross-sectional shape and have the same width and height (thickness). As one example, body 42 and connector plug 44 may combine to form a substantially flat, uniform connector where the body and connector plug seem as one. In still other embodiments, the cross section of body 42 has a different shape than the cross section of connector plug 44, for example, body 42 may have curved upper and lower and/or curved side surfaces while connector plug 44 is substantially flat.

FIG. 3C depicts the connector plug 44 of the connector plug 10 fully inserted into the connector receptacle 20 (the receptacle housing 30 is shown as transparent so that certain internal components are visible). As can be seen, when the connector plug 44 is fully inserted into the receptacle 20, the electrical contacts 22 engage with and electrically couple with the group of electrical contacts 12 on the top surface of the connector plug 10. Also, when the connector plug 44 is fully inserted and properly positioned within the receptacle 20 in the mated configuration, the corresponding retention features on each of the components are engaged, which helps ensure proper alignment of the components as well as retaining the connector plug 10 within the receptacle 20, as shown in FIG. 3C. As in some embodiments, the retention features 24 of the receptacle 20 are two spring-like resilient arms 24 that extend from base 27 at a rear portion of the receptacle housing 30 along each side of the receptacle housing 30 toward a distal retaining portion 25 near the opening of the cavity in which connector plug 44 is inserted. A portion of the spring arm 24 proximal of the retaining portion 25 is treated to create a reinforced portion 26 having a residual compressive stress layer, such as may be created by shot-peening an outer surface of the treated portion 26. Although in some embodiments, the entire spring arm 24 may be treated, improved fatigue strength of the mechanism can be obtained by treating a relatively small portion of the spring arm 24 that experiences the maximum stresses during cycling. The treated reinforced portion 26 may be less than 30% of the outer surface of the spring arm 24, such as about 25% or less than 10% of the outer surface of each retention spring-arm 24.

As shown in FIGS. 3A-3C, the first and second retention features 410 may be formed on the opposing sides of connector plug 44 within ground ring 105 and are adapted to engage with one or more corresponding features within the connector receptacle 20 to secure the connectors together when mated. Often, the retention features 14 are semi-circular indentations in the side surfaces of connector plug 44. The retention features may be widely varied and may include angled indentations or notches, pockets that are formed only at the side surfaces and do not extend to the top surface 44 or opposing bottom surface. The resilient spring arm retention features 24 of the receptacle 20 may include a tip or an angled or curved surface retaining portion 25 (such as the inwardly curved portion shown in FIGS. 3A-3C) that slides into and fits within the recessed retention features 14 of the connector plug 10.

In some embodiments, the retention features 24 of the receptacle are designed so that the curved retaining portion 25 that engages with the corresponding retention features 14 of the plug 10 is positioned near the opening of the cavity in which connector plug 44 is inserted. This may help better secure the connector sideways when it is in an engaged position within the connector receptacle. It is appreciated however, that either of the retention features could be located or positioned in any suitable location so that when engaged the retention features help retain the components in the proper alignment in the mated configuration.

Figure 4:
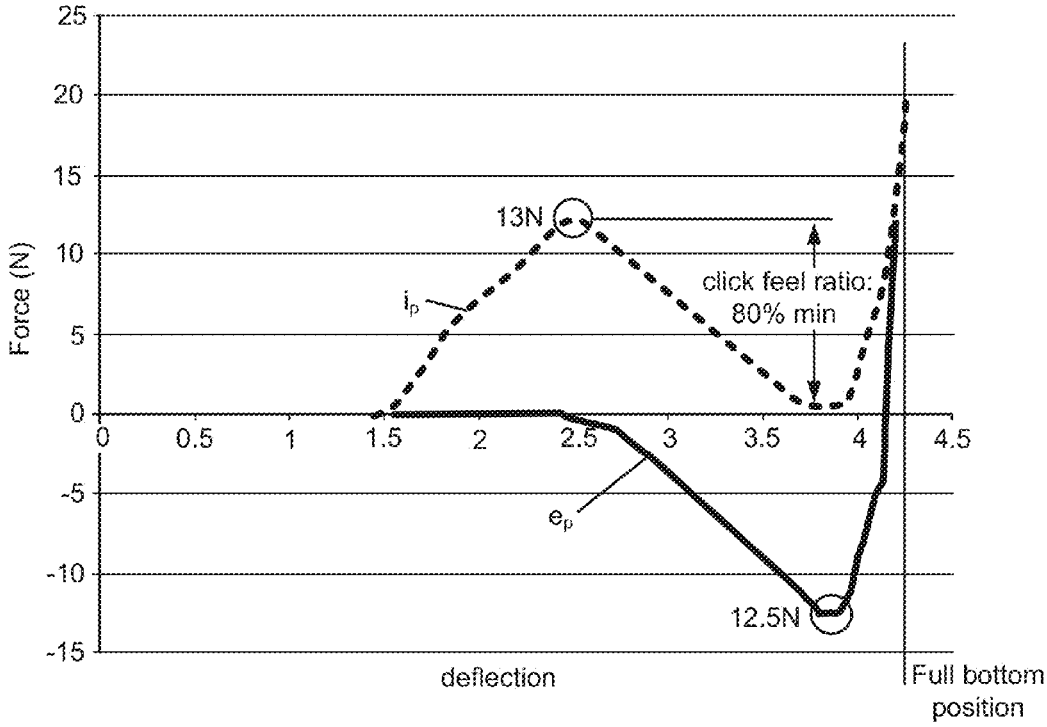
FIG. 4 shows an insertion and extraction performance profile relating to an example electrical connector device.

In an example embodiment, the angled and curved surfaces of corresponding retention features of the connector plug 44 and the connector receptacle 120 are configured so as to provide a desired insertion force and extraction force, such as the forces depicted in the insertion/extraction force profile shown in FIG. 4. The retention features of each of the connector plug and the connector receptacle can be designed or modified, such as by increasing or decreasing the curvature of one or both features or by changing the spring force exerted by the resilient arm, so as to provide desired insertion and extraction forces. In some embodiments, the force required to extract the connector plug 44 from the receptacle 120 is greater than the force required to insert the connector plug 44 into the receptacle 120. This aspect increases ease of use by allowing a user to easily insert the connector plug 44 of the connector plug 10 into the receptacle 120, and recognize when the connector plug 44 is properly positioned due to the tactile response resulting from engagement of the corresponding retention features, and further prevents inadvertent or accidental withdrawal of the connector plug 10 from the receptacle 120. As described above, in embodiments utilizing features similar to those in FIGS. 3A-3C, the insertion and extraction forces may vary according to a variety of factors that may include the angle or curvature of the recess and/or the corresponding resilient arm, as well as the material and width of the resilient arm itself.

Figure 5A:
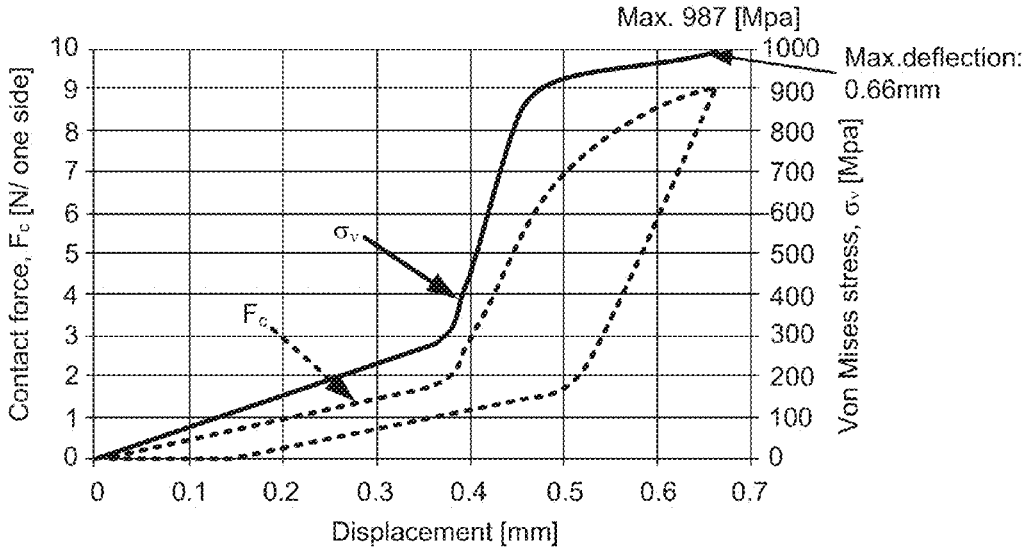
FIGS. 5A-5B depict the contact forces and stresses associated with use of an example electrical connector device.
Figure 5B:
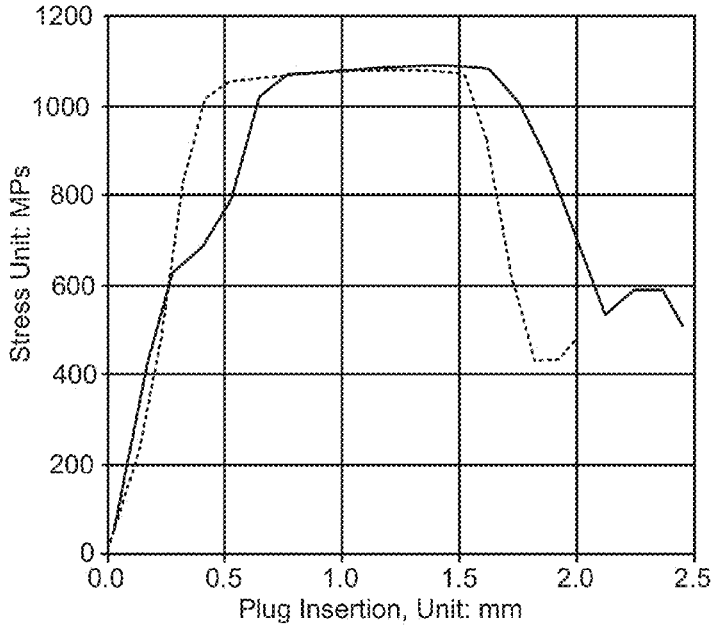

While the retention features described above offer significant advantages in some connector designs, these features may present additional challenges. For example, in an embodiment where the receptacle includes retention features comprising a pair of resilient arms extending on opposite sides of the receptacle, the lateral movement of the resilient arms while the connector plug is being inserted may result in substantial contact forces and stresses within the resilient arms or springs. Repeated cycling of these stresses and contact forces over many cycles of use may ultimately cause material failure or fatigue failure, resulting in cracking or breaking of the resilient arm. An example of typical contact forces and stresses associated with insertion and retraction of some connector devices using retention features similar to those described above is shown in FIGS. 5A-5B. As can be seen in FIG. 5A, in some connector devices, the contact forces can cause lateral deflection of a resilient arm retention feature to exceed a maximum allowable deflection, which would result in material failure.

Examples of material properties associated with materials commonly used in connector assemblies in accordance with some embodiments are presented in Table 1 below. In an example embodiment, 301 ¾ h Stainless Steel is used for the spring arms retention features due to its high stiffness and forming ability. In an untreated retention spring, material failure was noted after cycles of use ranging from 2,000 to 7,000 cycles. By treating a proximal portion of the retention spring to create a proximal reinforced portion having a layer of residual compressive stresses allows the retention spring, such as any of those described herein, to operate for over 10,000 cycles of use without material failure. Examples of the advantages in fatigue strength when using various methods of treatment to create a reinforced portion can be found in the experimental results depicted in FIGS. 10A-10D and FIGS. 12A-12C.

TABLE 1

Material Properties for Selected Spring Arm Materials

| | | E | Tensile Strength | Yield Strength | Fatigue/Endurance Limit |
|---|---|---|---|---|---|
| 301¾ h | L-direction | 193 GPa | 1250 MPa | 950 MPa | 850 MPa |
| 301¾ h | C-direction | 193 GPa | 1180 MPa | 850 MPa | 750 MPa |
| 301 h | L-direction | 193 GPa | 1400 MPa | 1250 MPa | 1000 MPa |
| 301 h | C-direction | 193 GPa | no data | no data | 850 MPa |

Figure 6A:
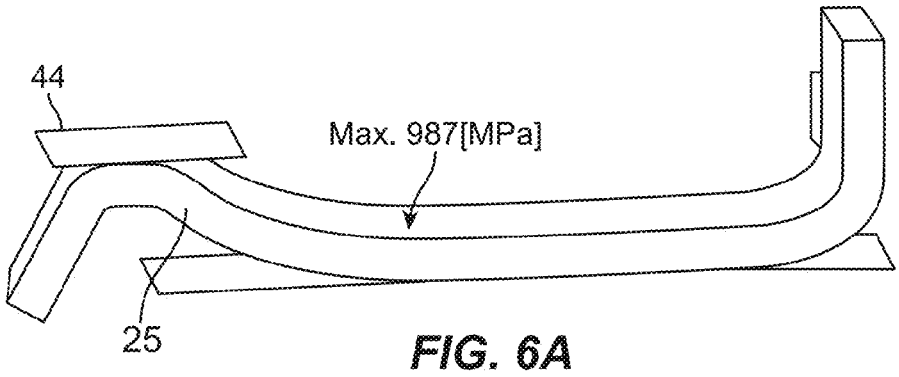
FIGS. 6A-6B depict the locations of contact forces and stresses seen in testing of an example retention device.
Figure 6B:
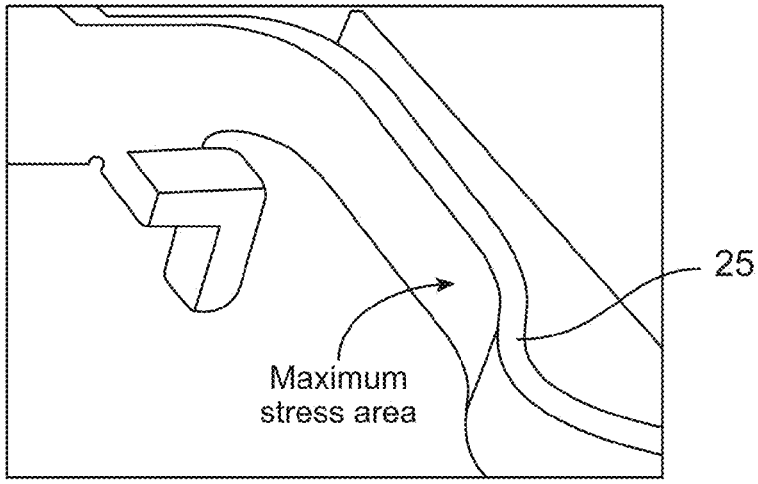

Examples of forces and stresses experienced by a spring-arm retention spring are illustrated in the stress models shown in FIGS. 6A-6B. Although the strength of the material can be modified by using a thicker or different material, generally such modifications affect the flexibility of the arm, which may result in an undesirable insertion/extraction profile. In some connector designs, the lateral outward displacement of the resilient arm retention feature may cause the resilient arm to contact a portion of the receptacle housing or other such component, which further increases the force and stresses within the resilient arm making material failure more likely.

In some embodiments using the resilient spring arms described above, the receptacle may further include a stress reducing member, such as any of the backup springs described in U.S. Provisional Application 61/597,705 and 61/602,057, the entire contents of which are incorporated herein by reference. Such backup springs may be positioned adjacent the angled or curved retaining portion that is received within the corresponding recess of the tab, to directly counter the forces applied by the connector plug 44 during insertion, although in some embodiments, the backup spring may be placed in other locations, such as closer to a mid-point of the resilient arm or closer to a rear portion of the resilient arm. Generally, the stress reducing member is positioned adjacent a side or outer surface of the resilient arm which faces away from the insertion axis along which the connector plug is inserted into the receptacle cavity, to allow the inner surface of the resilient arm to contact connector plug during insertion and be received within the recess of the connector tab. As the one or more resilient arms are displaced laterally outward during insertion of the connector tab, the resilient arm(s) contact and press against the stress reducing resilient member which helps relieve some of the forces exerted against the resilient arm(s) by the connector plug and the stresses within. Although in some embodiments, the increased fatigue strength improves the fatigue strength sufficiently to obviate the need for a stress reducing member.

Figure 7A:
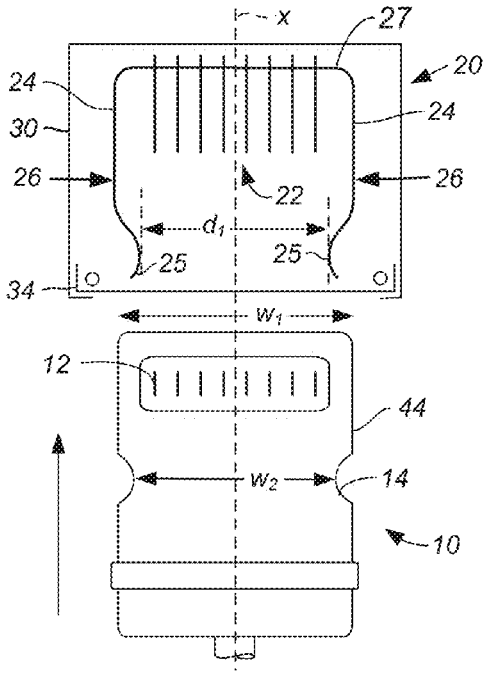
FIGS. 7A-7C illustrate sequential cross-sections along an insertion plane showing the insertion of a connector plug into a connector receptacle in an example connector.
Figure 7B:
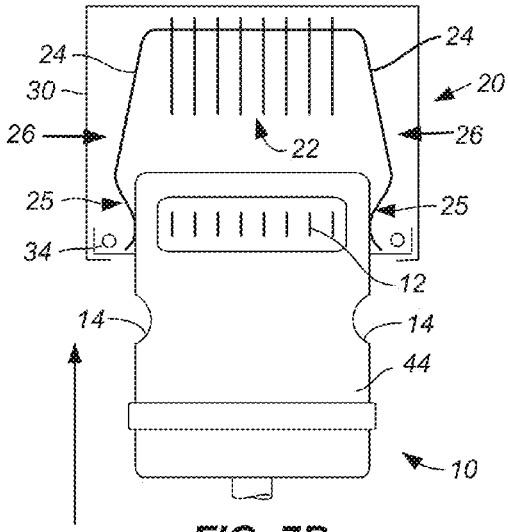
Figure 7C:
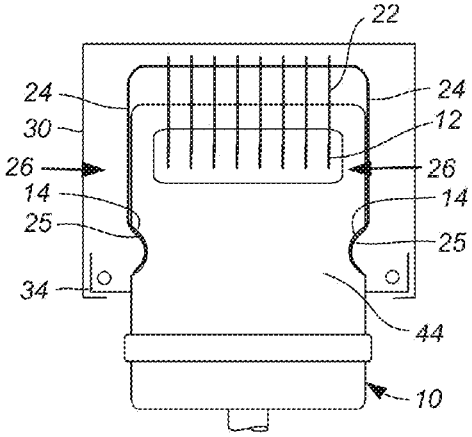

The use of a retention mechanism in accordance with an embodiment of the invention can be further understood by referring to FIGS. 7A-7C, which sequentially illustrates the insertion of a connector plug into a receptacle having such a retention mechanism. FIG. 7A shows an embodiment of a connector having a retention mechanism shown prior to insertion of the connector plug 10 in receptacle 20. As can be seen, the width of the front portion of the connector plug 44 (w1) is wider than the distance between the curved retaining portions 25 of the resilient arms 24 (d1) of the receptacle so that insertion of the connector plug 44 displaces the spring arms 24 laterally outward. It can also be seen that the width (w2) between the recessed retention features 14 is greater than the distance d1, so that when the plug 10 and receptacle 20 are in the mated configuration, the retaining portions 25 of the spring arms 24 exert a force on the connector plug 44 toward the insertion axis x.

FIG. 7B illustrates insertion of the leading portion of the connector plug 44 into the receptacle 20 between the spring arms 24, which displaces each of the spring arms 24 laterally outward away from the insertion axis (x). In some embodiments, the maximum stress is experienced by the spring arm retention spring 24 occurs at a proximal region during the maximum outward displacement of the spring arms, which is the region that is treated to create the reinforced portion 26. To inhibit stress fractures, treated reinforced portion 26 has been treated by a WPC treatment to provide a layer near the surface having residual compressive stresses. In some embodiments, region 26 is a transition area of the retention spring 24, the transition area having a narrowed region or shoulder.

FIG. 7C illustrates the connector plug 10 fully inserted within the receptacle 20 within the mated configuration, each of the electrical contacts 12 of the connector plug 10 electrically coupled with the electrical contacts 22 of the receptacle 20. As can be seen, the curved retaining portions 25 of the spring arm retention features 24 are engaged within the recessed retention features 14 of the connector plug 10 and the distance between the spring arms is w2, such that the spring arms are outwardly displaced in the mated configuration so as to provide a retaining force against the sides of the connector plug 44 as well as to ensure electrical contact so that the springs arms may function as a ground path for the ground ring of the connector plug 10.

Figure 8:
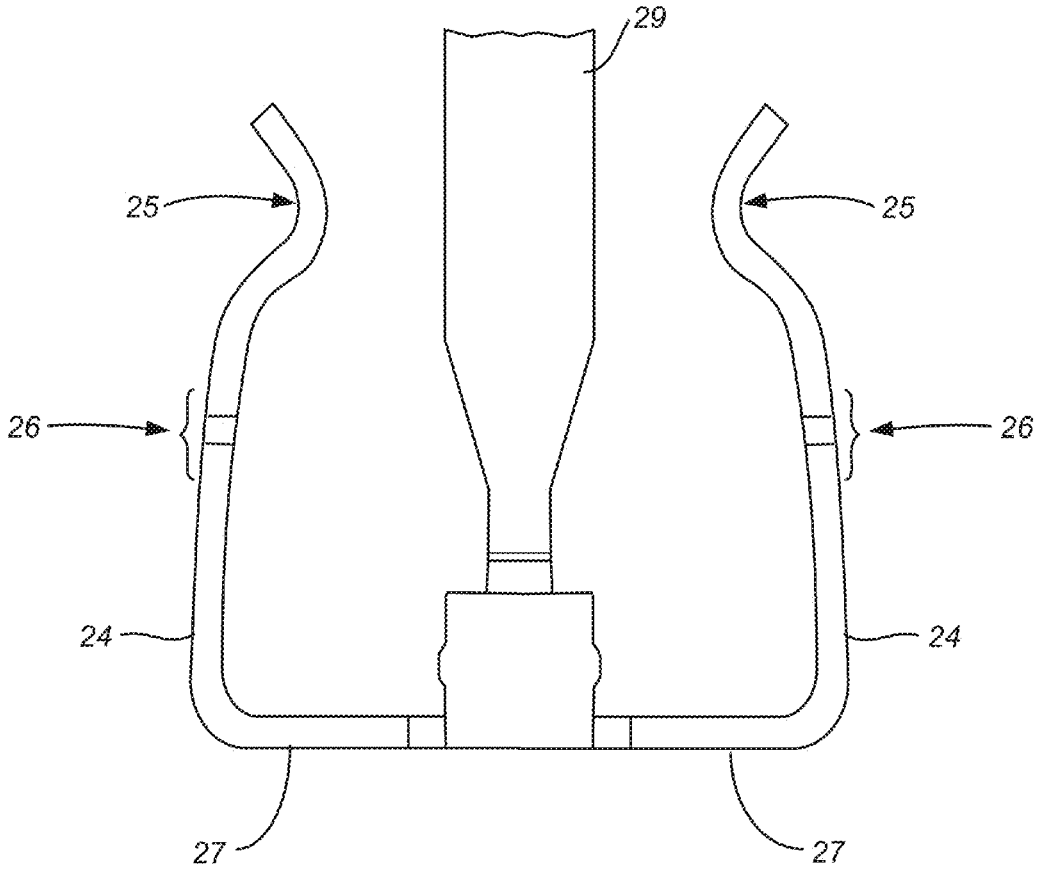
FIG. 8 shows an example pair of retention springs.

FIG. 8 depicts a pair of retention springs, such as may be used in a retention mechanism as described in FIGS. 7A-7C. The pair of retention springs 24 may remain on a T-shaped bar of metal 29 from which the retention mechanism is formed to facilitate treatment with a shot peening method, such as a WPC treatment, the retention springs 24 being supported sufficiently on metal bar 29 so as to withstand the forces associated with shot peening. In a typical shot peening method small beads are shot at a surface in a controlled manner to create a layer of residual stresses beneath the treated surface. Treatment may use glass beads, a hard ceramic (e.g. silicon nitride), or metal beads (e.g. iron or steel beads). The beads may be anywhere from 1 to 200 microns, often about 100 microns and are shot at sufficient power to compress the material, often within a range of pressures or powers (e.g. low, medium or high power). Generally, low power is about 50 psi, medium power is about 100 psi and high power is about 150 psi, although it is appreciated that power may be varied within a given range if desired, such within +/−25 psi from the above noted powers. Generally, the entire outer surface of the treated area 26 is shot peened so that the surface is hit by the shot evenly from all outside angles. This may be accomplished by shot peening the treated zone from different sources disposed at different areas to hit the surface from various angles, such as two peening sources on one side of the retention spring to direct shot to an outer facing surface from two different angles and two sources adjacent the opposing side to direct shot to an inner facing surface of the reinforced portion 26.

Although, the entire retention spring 24 may be treated, the above noted improvements in performance and fatigue strength can be obtained from treating a select portion of the retention spring 24 proximal of the curved retaining portion 25, such as a select portion may be confined to an area that experiences the greatest stress during the maximum outward displacement of the spring-arm retention springs 24. In an embodiment in which the spring-arm has a shoulder region that reduces in width near a mid-portion of the spring arm, as shown in FIG. 8, the select portion may be an area of at least a couple millimeters at the shoulder region, such as a region of about 2-4 millimeters roughly centered on the shoulder region so that the reinforced portion 26 extends about 2-4 millimeters in width along the insertion axis and circumscribes the spring arm so as to inhibit fatigue failure near the shouldered region. In a retention mechanism of a connector receptacle in which the connector plug has an insertion depth of about 8 mm, the reinforced portion 26 of the spring arm is located along a mid-portion of the spring arm proximal of an inwardly curved retaining feature 25. In some embodiments, the reinforced portion is at a shouldered region on the spring arm, at which the vertical width of the spring arm reduces, disposed about 4 mm from the base of the retention mechanism from which each spring arm 24 extends.

Figure 9A:
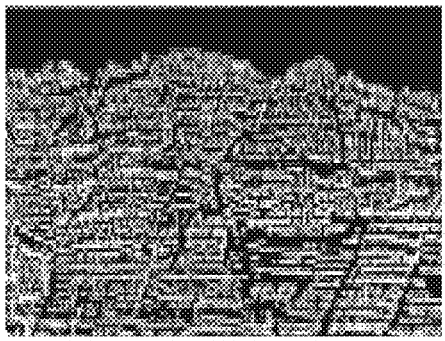
FIGS. 9A-9B illustrate cross-sectional views of a proximal portion of the retention spring before and after treatment in an example connector receptacle.
Figure 9B:
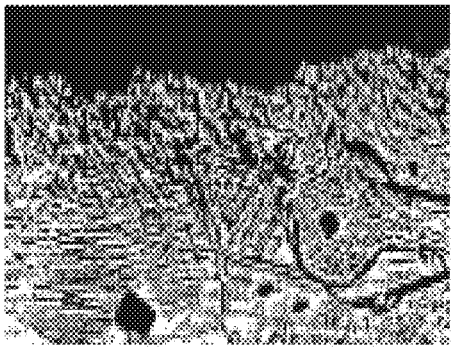

FIGS. 9A-9B shows a magnified view (×400) of a cross section of a surface of a treated zone 26 of the example retention spring 24 in FIG. 8, taken before and after treatment. FIG. 9A shows a cross-section before treatment, while FIG. 9B shows a cross-section taken after a shot peening treatment, specifically a WPC treatment, that created a layer having residual compressive stresses of at least 1500 MPa and extending to a depth of about 5 μm to 15 μm from the surface, such as a depth of about 10 μm from the surface.

Fatigue testing was conducted on various retention springs treated according to various differing shot peening methods by stressing the retention springs over many cycles of use. In some embodiments, the reinforced portion 26 is confined to an area of a spring arm 24 at which the width of the spring arm 24 narrows at a shoulder 26, as shown in FIG. 10B. The reinforced portion may include an area of at least a few millimeters at the narrowed, should region, such as an area about 2-10 millimeters wide. Each of the example retention springs 24 was cycled to simulate the stresses each would experience during normal use, as described in FIGS. 7A-7C.

An example retention spring 24 without a treated area 26 experienced failure between 2 k and 7 k cycles of use (out of five samples of five experience fatigue failure). An example retention spring 24 that included a region 26 treated by a shot peen treatment using 100 micron iron beds at low shot power (about 50 psi) resulted in a retention spring that was able to endure 10 k cycles of use without experience fatigue failure (out of three samples, none failed). An example retention spring 24 that included a region 26 treated by a shot peen treatment as described above using 100 micron iron beds at medium shot power (about 100 psi) resulted in a retention spring that was able to endure 10 k cycles of use without experience fatigue failure (out of three samples, none failed). An example retention spring 24 that included a region 26 treated by a shot peen treatment as described above using 100 micron iron beds at high shot power (about 150 psi) resulted in retention springs 24 that failed at about 9 k cycles of use (two samples of four failed at about 9 k cycles of use). Thus, to provide improved fatigue strength, low and medium power shot peening is used in some embodiments.

Figure 10A:
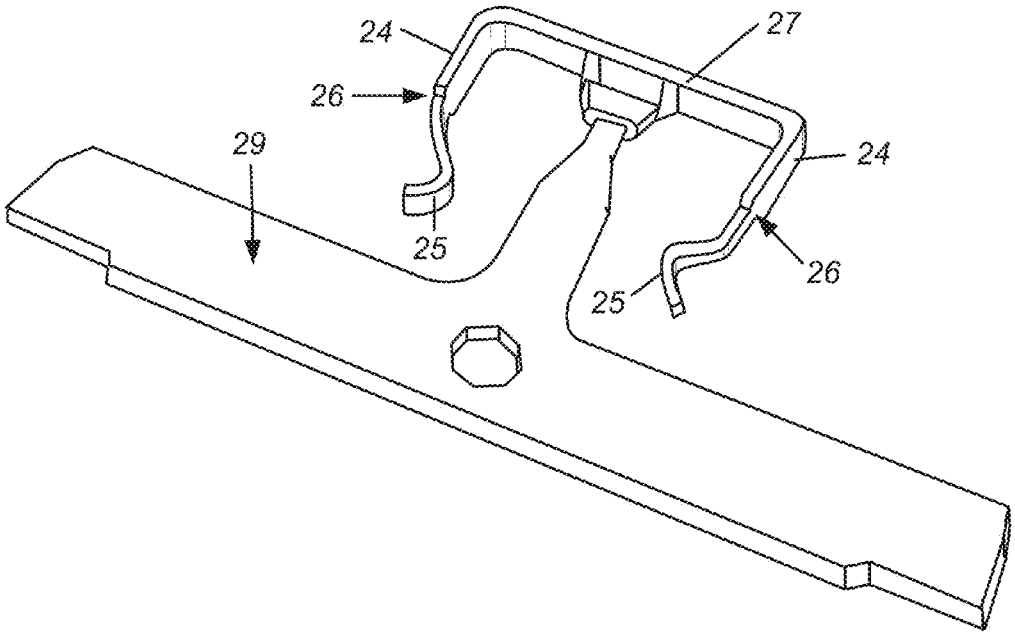
FIGS. 10A-10B show an example retention spring and supporting metal tab from which the spring is formed and a detail view of one of a pair of springs in the example retention spring, respectively.
Figure 10B:
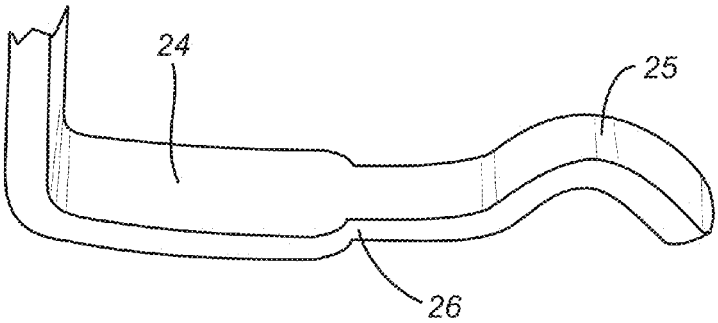

An example of a retention spring is shown in FIG. 10A, the retention spring pair is shown still attached to the metal bar 29 from which the retention spring is formed. The retention spring may remain attached to metal bar 29 to facilitate treatment of portion 26 as described herein. The retention spring includes a pair of retention springs 24 extending from a proximal base 27 to a distal inwardly curved retaining portion 25. A proximal portion 26 has been treated to provide a layer having residual compressive stress to improve the fatigue strength of each retention spring. The pair of retention springs may be mounted on the T-shaped tab 29 to support the retention springs during the shot peening treatment. As can be seen in FIG. 10B, the example retention spring arm 24 includes a transition area that narrows to a smaller width. Accumulation of stresses near the shoulder of this transition area can cause tiny stress fractures to occur that propagate and lead to fatigue failure within the transition area; thus, to improve fatigue strength, the retention spring can be treated in this transition area, such as by a shot peening or WPC treatment, to create reinforced portion 26.

Additional fatigue failure testing was conducted on various retention springs treated according to three different shot peening methods: (Method A) glass beads shot at a low power, (Method B) metal beads shot at a medium power, and (Method C) metal beads shot at a higher power. Each of the example retention springs was cycled until fatigue failure occurred. The retention spring treated according to Method A experienced fatigue failure at 12 k cycles; the retention spring treated according to Method B experienced fatigue failure at 10 k cycles; and the retention spring treated according to Method C experienced fatigue failure at 10 k cycles. In each instance of fatigue failure, failure resulted from a stress fracture that originated inside the transition area at the shoulder.

Table 2, below, shows surface roughness measurements of the example retention spring in each of Methods A, B and C described above. As can be seen, Method A resulted in the smoothest surface, while Methods B and C resulted in an increasingly uneven surface, the higher shot peening power associated with the more uneven surface.

TABLE 2

Surface Roughness of Tested Spring-Arms

| | Ra (μm) | Ry (μm) | Rz (μm) |
|---|---|---|---|
| A | 0.233 | 1.605 | 1.212 |
| B | 0.369 | 2.613 | 2.116 |
| C | 0.584 | 4.178 | 3.168 |

Table 3, below, illustrates the residual compressive stresses formed by each of the above noted methods in the treated zone (TZ) as well as in a treated area of the metal bar (for comparison purposes).

TABLE 3

Residual Compressive Stresses

| | Metal Bar | Treated Zone (TZ) |
|---|---|---|
| A | 632 ± 157 MPa | 746 ± 243 MPa |
| B | 409 ± 106 MPa | 362 ± 243 MPa |
| C | 280 ± 60 MPa | −26 ± 528 MPa |

Figure 11:
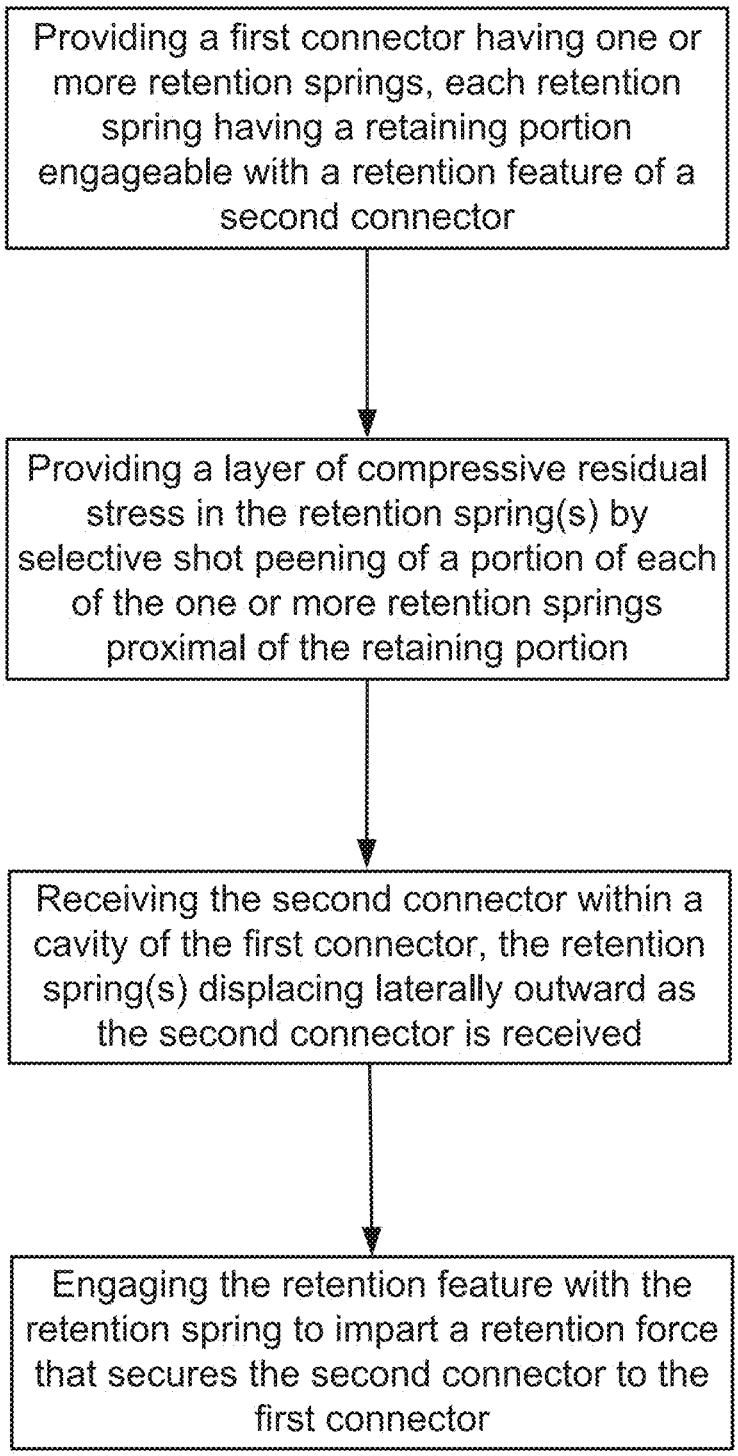
FIG. 11 shows an example method.

FIG. 11 depicts an example method in accordance with some embodiments. The example method includes: providing a first connector having one or more retention springs, each retention spring having a retaining portion engageable with a retention feature of a second connector; providing a layer of compressive residual stress in the retention spring(s) by selective shot peening of a portion of each of the one or more retention springs proximal of the retaining portion, such as by a WPC treatment using a low or medium power; receiving the second connector within a cavity of the first connector, the retention spring(s) displacing laterally outward as the second connector is received; and engaging the retention feature with the retention spring to impart a retention force that secures the second connector to the first connector.

The above described embodiments are intended to illustrate examples of certain applications of the invention in relation to electrical connectors, and does not so limit the invention to these embodiments. It is appreciated that any of the components described in any of the embodiments may be combined and or modified in accordance with the invention. For example, an embodiment may include a combination of one or more of the backup springs described herein within an electrical connector or other such application, or may include one or more variations and equivalents to the features described herein as would be clear given the disclosure provided herein.

What is claimed is:

1. A method of fabricating a retention latch assembly for retaining a plug connector releasably coupled within a receptacle connector of a device in a mated configuration, the method comprising:

providing one or more retention spring arms for placement within the receptacle, each retention spring arm comprising a distal retaining portion that curves inwardly toward an insertion axis along which the plug connector is inserted into the receptacle and is configured to engage a corresponding retention feature of the plug connector when the plug connector is coupled with the receptacle connector; and creating a reinforced portion in each of the one or more retention spring arms at a select location entirely proximal of the distal retaining portion by forming a compressive residual stress layer therein.

2. The method of claim 1, wherein forming the compressive residual stress layer comprises shot peening the one or more spring arms at the select location.

3. The method of claim 1, wherein the compressive residual stress is greater than 1,000 MPa.

4. The method of claim 2, wherein shot peening comprises a WPC treatment.

5. The method of claim 2, wherein shot peening is performed with beads of glass, ceramic or metal.

6. The method of claim 5, wherein the beads are between 50-150 microns.

7. The method of claim 6, wherein the beads are shot at a pressure between 25 and 125 psi.

8. The method of claim 7, wherein the beads are shot at the select location at a pressure between 50 psi and 100 psi.

9. The method of claim 5, wherein the beads are shot at the select location from a plurality of angles about the select location of the spring arm so that the layer of residual compressive stress substantially circumscribes the spring arm at the select location.

10. The method of claim 5, wherein the select location is an area at which a maximum stress occurs during a maximum displacement of the spring arm during a cycle of use.

11. The method of claim 5, wherein the select location includes a transition area at which a vertical width of the respective spring arm narrows.

12. The method of claim 2, wherein the select location includes less than 30% of the outer surface of the entire spring arm.

13. The method of claim 9, wherein the one or more retention spring arms comprise a pair of resilient spring arms, each spring arm extending distally from a proximal base to the distal retaining portion of the respective spring arm, wherein the beads are shot at the select location so that the compressive residual stress layer extends to a depth of about 5 to 10 μm below the surface of the select portion.

14. The method of claim 13, wherein the select location includes a shouldered transition area of the spring arm at which a vertical width of the spring arm narrows, the transition area being located about midway between the proximal base and the distal retaining portion on each respective arm.

15. The method of claim 14, wherein the select portion extends a length of about 2-5 mm along a direction of the insertion axis.

* * * * *